United States Patent [19]

Uehara et al.

[11] 4,351,178

[45] Sep. 28, 1982

[54] APPARATUS FOR BENDING A STRAIGHT TUBE INTO A SERPENTINE TUBE

[75] Inventors: Katuharu Uehara; Izumi Ochiai, both of Ohiramachi, Japan

[73] Assignee: Hitachi, Ltd., Tokyo, Japan

[21] Appl. No.: 317,840

[22] Filed: Nov. 3, 1981

Related U.S. Application Data

[63] Continuation of Ser. No. 62,993, Aug. 2, 1979, abandoned.

[51] Int. Cl.[3] ..... B21D 7/02; B21D 31/00

[52] U.S. Cl. ..... 72/383; 72/217; 72/390

[58] Field of Search ..... 72/212, 213, 217, 218, 72/383, 384, 385, 389, 390, 369

[56] References Cited

U.S. PATENT DOCUMENTS

| | | | |
|---|---|---|---|
| 1,462,315 | 7/1923 | Akey et al. | 72/217 X |
| 1,501,388 | 7/1924 | Baker | 72/217 |
| 3,168,129 | 2/1965 | Henry | 72/390 |
| 3,429,168 | 2/1969 | Pearson et al. | 72/389 |
| 3,597,956 | 8/1971 | Clausing | 72/389 |
| 3,628,369 | 12/1971 | Williamson | 72/385 |
| 3,908,425 | 9/1975 | Ware | 72/217 |
| 4,141,235 | 2/1979 | Ishihara | 72/389 |

FOREIGN PATENT DOCUMENTS

| | | | |
|---|---|---|---|
| 619001 | 9/1935 | Fed. Rep. of Germany | 72/212 |
| 43-12992 | 6/1968 | Japan | 72/389 |
| 1250314 | 10/1971 | United Kingdom | 72/385 |
| 547261 | 2/1977 | U.S.S.R. | 72/385 |

*Primary Examiner*—Ervin M. Combs

*Attorney, Agent, or Firm*—Antonelli, Terry & Wands

[57] ABSTRACT

Apparatus for producing a serpentine tube by bending a straight tube including a plurality of dies each having an arcuate surface, the dies being arranged alternately on opposite sides of the straight tube and movable in a direction toward the center axis of the straight tube and at the same time in a direction intersecting the center axis of the straight tube. During a bending operation, the dies are spaced apart from one another in a manner to impart to the straight tube and the serpentine tube such a dimensional relationship that no excess material is produced in the tube. Each die forms a set with two wings, the two wings being operative to force the straight tube against the arcuate surface of the associated die while rotatingly moving for a circumferential extent of 90 degrees each along the arcuate surface of the die. Each set of die and wings is mounted on one of a plurality of front-to-rear ball screws supported for movement by a plurality of left-to-right ball screws. The front-to-rear ball screws and the left-to-right ball screws have their movements controlled by respective pulse motors.

1 Claim, 9 Drawing Figures

APPARATUS FOR BENDING A STRAIGHT TUBE INTO A SERPENTINE TUBE

This is a continuation of application Ser. No. 62,993, filed Aug. 2, 1979, abandoned.

BACKGROUND OF THE INVENTION

This invention relates to apparatus for bending a straight tube into a serpentine tube.

As is well known, a serpentine tube used in electrical equipment is generally produced by working a straight tube 1 to form straight portions 2 and bent portions 3 therein, as shown in FIG. 1.

One type of apparatus for producing a serpentine tube of the prior art comprises a semicircular die 4 and a wing 5, as shown in FIGS. 2 to 4. In operation, a portion of the straight tube 1 to be formed into a bent portion is held between the semicircular die 4 and the wing 5, and the wing 5 is moved in rotary motion along the circumference of a circle concentric with the semicircular die 4 for an extent on the order of 180 degrees as indicated by a dash-and-dot line in FIG. 2, to form a first bent portion 3*a*. Then, the straight tube 1 is moved axially thereof (in the direction of an arrow in FIG. 3) for a distance L corresponding to the length of the straight portions 2. Thereafter, the straight tube 1 is moved a distance corresponding to twice the radius R of the bend of the bent portion in a direction perpendicular to the length of the straight tube 1 to hold, as shown in FIG. 3, between the die 4 and the wing 5, a portion of the straight tube 1 to be bent. The wing 5 is moved in rotary motion along the circumference of a circle concentric with the semicircular die 4 for an extent on the order of 180 degrees as indicated by a dash-and-dot line to form a second bent portion 3*b*. This operation is repeated to form a desired number of bent portions 3, to produce a serpentine tube.

The apparatus for producing a serpentine tube of the prior art described hereinabove has had the disadvantage that the production of a serpentine tube is a time-consuming operation and high in operating cost because the bent portions 3 are successively formed and a large number of working steps should be followed when the number of bent portions 3 is large, thereby making it impossible to provide a serpentine tube of low cost for use in heat exchangers, etc.

In order to obviate the disadvantage of the prior art, proposals have been made to use a link mechanism in apparatus for producing a serpentine tube. However, the use of a link mechanism has a serious disadvantage in that, since the spacing between bending heads is constant at all times during the operation, excess material is consumed in bending a straight tube, with a result that buckling is caused to occur in the bent portions.

SUMMARY OF THE INVENTION

This invention has as its object the provision of an apparatus for bending a straight tube into a serpentine tube which obviates the disadvantages of the apparatus of the prior art.

The outstanding characteristics of the present invention are that a plurality of dies each having an arcuate surface are arranged in parallel and alternately on opposite sides of a straight tube, and the dies are moved toward the longitudinal axis of the straight tube and at the same time in a direction intersecting the longitudinal axis of the straight tube. While a bending operation is being performed, the dies are spaced apart from one another a distance such that no excess material is produced in the straight tube.

DESCRIPTION OF THE PREFERRED EMBODIMENT

Figure 1:
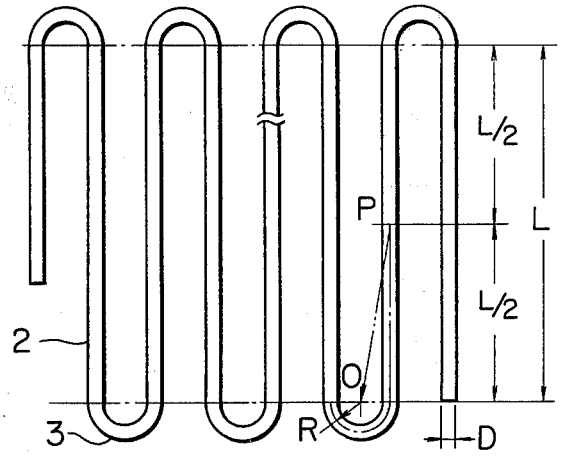
FIG. 1 PRIOR ART
FIG. 1 is a view in explanation of the shape of a serpentine tube for use in heat exchangers, etc., produced by bending a straight tube.
Figure 2:
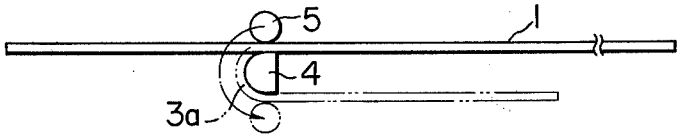
FIG. 2 PRIOR ART
FIGS. 2 to 4 are views in explanation of apparatus of the prior art for bending a straight tube into a serpentine tube.
Figure 3:
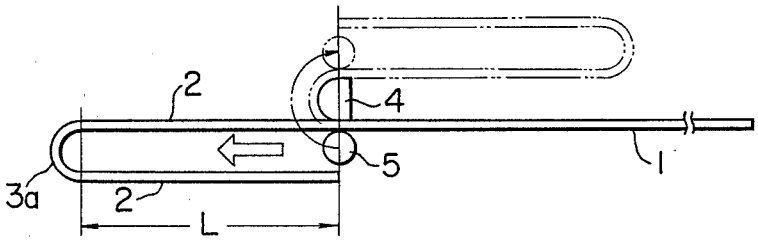
FIG. 3 PRIOR ART
Figure 4:
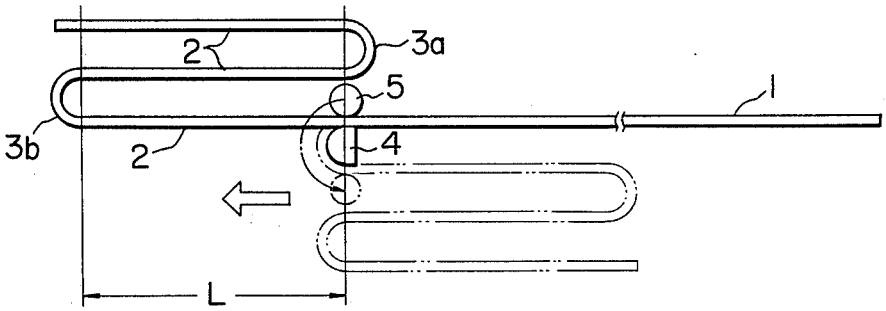
FIG. 4 PRIOR ART
Figure 5:
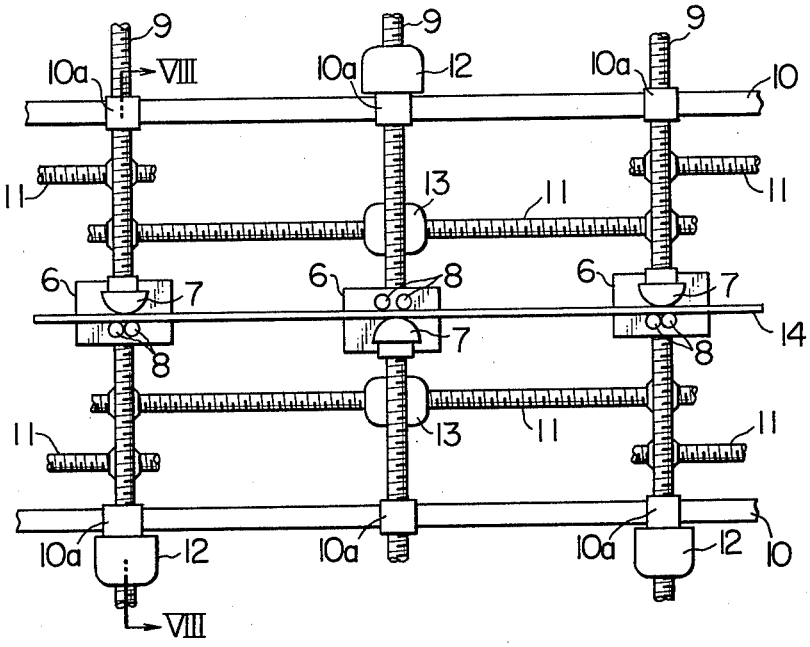
FIGS. 5 to 6 are views in explanation of the apparatus for producing a serpentine tube according to the present invention, shown at different operation steps.
Figure 6:
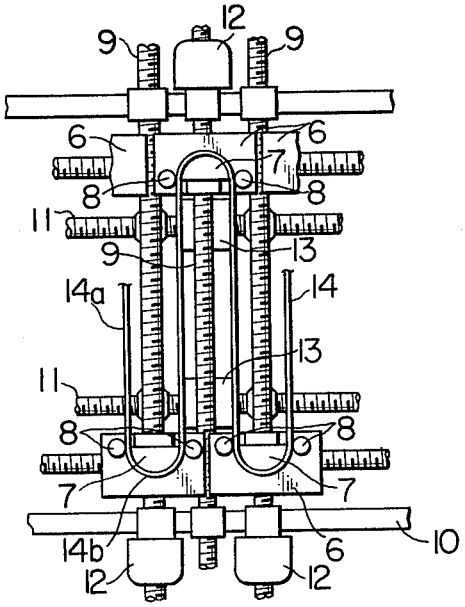
Figure 7:
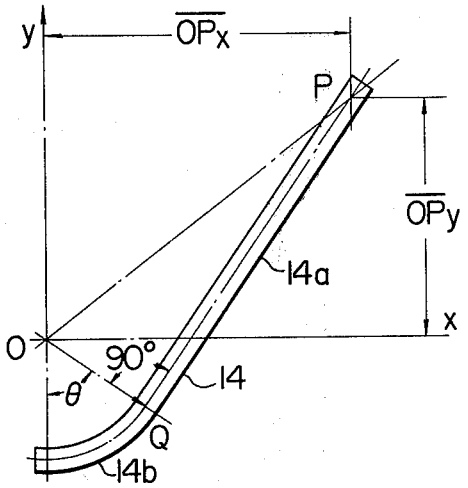
FIG. 7 is a graph showing the deformation of a straight tube taking place during a bending operation performed by the apparatus according to the present invention.
Figure 8:
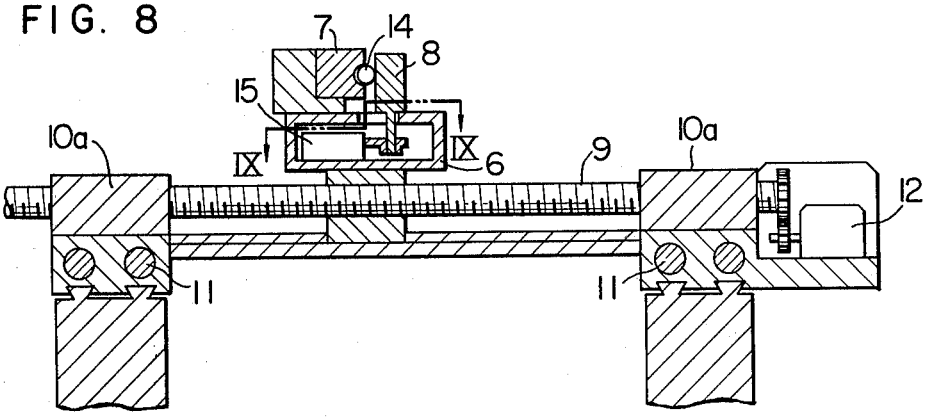
FIG. 8 is a sectional view taken along the line VIII—VIII in FIG. 5.
Figure 9:
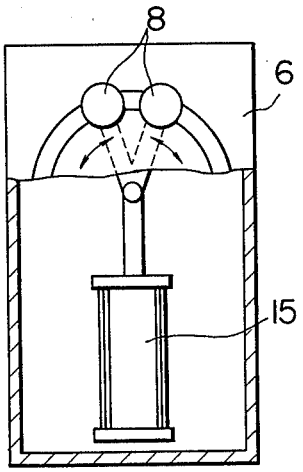
FIG. 9 is a sectional view taken along the line IX—IX in FIG. 8.

A preferred embodiment of the present invention will now be described by referring to FIGS. 5 to 9. As shown in FIG. 5, a plurality of bending heads 6 are each secured to one front-to-rear ball screws 9 in such a manner that prior to a commencing of a bending operation, all the bending heads 6 are disposed in a straight line extending from left to right in FIG. 5. The bending heads 6 are of a height such that they are flush with one another. The numeral 7 designates semicircular dies each secured to the upper surface of one of the bending heads 6. The numeral 8 designates wings, with two wings 8 being located on the upper surface of the respective bending heads 6. Prior to a commencement of a bending operation, the two wings 8 on each bending head 6 are disposed adjacent each other and juxtaposed against an arcuate surface of the die 7 on the same bending head 6 in such a manner that the wings 8 and die 7 are spaced apart from each other by a distance corresponding to a thickness of a straight tube 14 to be bent. The positions of the wings 8 and die 7 on each bending head 6 are reversed from those on the adjacent bending heads 6, so that the straight tube 14 can be held between the die 7 and the wings 8 disposed alternately at regular intervals on the bending heads 6. Although not shown, the two wings 8 are mounted on each bending head 6 for movement, while rotating, along the arcuate surface of the die 7 for a circumferential extent of about 90 degrees each from the position shown in FIG. 5 to the position shown in FIG. 6. It is to be understood, however, that the wings 8 need not move along the arcuate surface of the die 7 for a circumferential extent of 90 degrees each so long as the wings 8 are positioned advantageously with respect to the angle through which the straight tube 14 is bent, and that the wings 8 may move along a straight line back and forth in FIG. 5.

The front-to-rear ball screws 9 each extend in a straight line bisecting the angle of circumference of one of the dies 7. Each front-to-rear ball screw 9 is mounted on guide rails through retainers 10*a* in such a manner that each ball screw 9 is capable of back-and-forth movement along grooves, not shown. The front-to-rear ball screws 9 are equal in number to the bending heads 6, and the number of front-to-rear ball screws 9 is one less than the number of bends to be formed in the straight tube 14. The guide rails 10 are two in number and arranged parallel to each other on opposite sides of the straight tube 14 held between the wings 8 and the dies 7 on the bending heads 6. The guide rails 10 are parallel to the straight tube 14 held between the wings 8 and dies 7 prior to commencement of a bending operation. The numeral 11 designates left-to-right ball screws each of which has three front-to-rear ball screws 9 forming a set connected to its right end, center and left end respectively, through guide grooves, not shown, located on the under-side of the ball screws 9. The left-to-right ball screws 11 are mounted in two stages in the front and rear.

The numeral 12 designates pulse motors each for controlling the movement of one of the front-to-rear ball screws 9. Each pulse motor 12 receives a signal from a computer or a numerical control apparatus, for example, for rotating the respective front-to-rear ball screw 9 and moving the respective bending head 6 back and forth. The front-to-rear ball screws 9 are alternately moved back and forth in opposite directions by the pulse motors 12. The numeral 13 designates pulse motors each for controlling the movement of one of the left-to-right ball screws 11. Each pulse motor 13 receives a signal from a computer or a numerical control apparatus, for example, for rotating the respective left-to-right ball screw 11 and moving the respective bending head 6 and the respective front-to-rear ball screw 9 leftwardly and rightwardly. The use of electrical pulse motors is not essential for effecting movement of the bending head 6 leftwardly and rightwardly, and pantographs or other mechanical device may be used to attain the end so long as the bending heads 6 can be accurately positioned with respect to the front-to-rear ball screws 9 and the left-to-right ball screws 11.

In operation, the straight tube 14 is placed on the bending heads 6 in such a manner that the tube 14 is interposed between the dies 7 and the wings 8 as shown in FIG. 5. Then, cylinders, not shown, each mounted on one of the bending heads 6 are actuated to cause the wings 8 to force the straight tube 14 against the dies 7, and the pulse motors 12 and 13 are simultaneously actuated to form the straight tube 14 into a serpentine tube.

More specifically, the front-to-rear ball screw 9 in the middle in FIG. 5 rotates as the pulse motor 12 thereon is actuated, to move the bending head 6 rearwardly. The rearward movement of the bending head 6 results in the straight tube 14 being deformed in conformity with the arcuate surface of the die 7. In this case, the two wings 8 each rotate for a circumferential extent of 90 degrees on a semicircle concentric with the die 7 as the front-to-rear ball screw 9 rotates while forcing the straight tube 14 against the die 7, to ensure that the straight tube 14 is deformed without fail. At the same time, the front-to-rear ball screws 9 on the left and right of the front-to-rear ball screw 9 in the middle in FIG. 5 are rotated by the respective pulse motors 12 so as to move the bending heads 6 forwardly. The pulse motors 13 rotate the left-to-right ball screws 11 to move the front-to-rear ball screws 9 on the left and right sides in a direction in which the bending heads 6 thereon move toward the bending head 6 in the middle in FIG. 5. Thus the bending head 6 on the left side moves rightwardly forwardly while the bending head 6 on the right side moves leftwardly forwardly, with a result that the straight tube 14 is deformed in conformity with the arcuate surface of each of the dies 7. In this case, the two wings 8 of the bending head 6 on the right side and the two wings 8 of the bending head on the left side operate in the same manner as the wings 8 of the bending head 6 in the middle, to ensure that the straight tube 14 is deformed into a serpentine tube. It is necessary that the rotation of the front-to-rear ball screws 9 and the left-to-right ball screws 11 take place in conjunction with the rotation of the wings 8.

The dimensional relationship between the straight tube 14 and the serpentine tube produced by deforming the straight tube 14 will now be discussed. The deformation achieved by subjecting the straight tube 14 to a bending operation should satisfy the following equation in order that no excess material may be produced in the tube 14:

$$\overline{PQ} = \frac{L}{2} + \pi R\left(\frac{90^\circ - \theta}{180^\circ}\right) \tag{1}$$

where $\overline{PQ}$: half the length of straight portions of tube 14 during a bending operation.

L: the length of straight portions of tube 14 upon completion of a bending operation.

R: the radius of bent portions of tube 14.

$\theta$: bending angle of bent portions of tube 14.

From equation (1), the dimension of the tube between the adjacent two dies 7 can be expressed as shown in equation (2) wherein the length $\overline{OP}$ of the tube 14 between the center of a bent portion 14*b* and the center of a straight portion 14*a* is expressed for the convenience of explanation.

$$\overline{OP} = \sqrt{R^2 + \left[\frac{L}{2} + \pi R\left(\frac{90^\circ - \theta}{180^\circ}\right)\right]^2} \tag{2}$$

It will be apparent in equation (2) that when the bending angle ($\theta$) is varied from 0° to 90°, the change caused to occur in $\overline{OP}$ is equivalent to $(\pi/2)R$. Serpentine tube producing apparatus of the prior art using a link mechanism have been unable to change the length of the link in an amount equivalent to $(\pi/2)R$ during the process of a bending operation. Thus excess material was produced at the end of the bending operation.

The equation (2) can be rewritten so that a left-right (X-direction) component $\overline{OP}x$ and a front-to-rear (Y-direction) component $\overline{OP}y$ are expressed by formulas (3) and (4) respectively as follows:

$$\overline{OP}x = R\sin\theta + \left[\frac{L}{2} + \pi R\left(\frac{90^\circ - \theta}{180^\circ}\right)\right]\cos\theta \tag{3}$$

$$\overline{OP}y = -R\cos\theta + \left[\frac{L}{2} + \pi R\left(\frac{90^\circ - \theta}{180^\circ}\right)\right]\sin\theta \tag{4}$$

Thus, if the spacing interval between the dies 7 is not uniform and the dies 7 are moved in the X-direction and Y-direction in conformity with the bending angle $\theta$ in a manner to satisfy the equations (3) and (4), no excess material will be produced during a bending operation and no buckling will occur in the bends. One has only to control the pulse motors 12 and 13 to rotate the ball screws 9 and 11, to move the dies 7.

From the foregoing description, it will be appreciated that the present invention enables a straight tube to be bent into a serpentine tube simultaneously in a plurality of stages. Thus the invention offers the advantages that the number of working steps can be greatly reduced, and that the occurrence of buckling in the bends of the serpentine tube produced can be avoided because no excess material is produced during a bending operation performed by the apparatus according to the invention.

What is claimed is:

1. Apparatus for producing a serpentine tube for use with a heat exchanger or the like by bending a straight tube comprising:

bending head means movable both longitudinally and transversely for forming bends in the straight tube; and drive means for moving said bending head means longitudinally and transversely;

motor means associated with said drive means to drive dies in the direction of a center axis of the straight tube and, at the same time, in a direction intersecting said axis at a different speed, wherein the improvement resides in that said bending head means comprises a fixed die provided with an arcuate surface for forming a bent portion of the serpentine tube by bending the straight tube, and a pair of wings associated with said fixed die to hold the straight tube between the die and the two wings and push the tube to the arcuate surface of the die during a bending operation, said two wings moving symmetrically to right and left respectively from the apex of the arcuate surface to said die, and means actuating both of said two wings to rotate 90° against and around the arcuate surface of each die for effecting bending of said serpentine tube without producing excess material by maintaining a dimensional relationship between the straight tube and the serpentine tube which satisfies following equation:

$$\overline{PQ} = \frac{L}{2} + \pi R\left(\frac{90-\theta}{180}\right)$$

where:

$\overline{PQ}$: half length of straight tube portion during a bending operation of the tube;

L: length of straight portion on completion of bending operation;

R: the radius of bent portion of tube;

$\theta$: bending angle of bent portion of tube.

* * * * *